US008088261B2

(12) United States Patent
Fan et al.

(10) Patent No.: US 8,088,261 B2
(45) Date of Patent: Jan. 3, 2012

(54) CUC1 THERMOCHEMICAL CYCLE FOR HYDROGEN PRODUCTION

(75) Inventors: Qinbai Fan, Chicago, IL (US); Renxuan Liu, Chicago, IL (US)

(73) Assignee: Gas Technology Institute, Des Plaines, IL (US)

( * ) Notice: Subject to any disclaimer, the term of this patent is extended or adjusted under 35 U.S.C. 154(b) by 1267 days.

(21) Appl. No.: 11/803,627

(22) Filed: May 15, 2007

(65) Prior Publication Data

US 2008/0283390 A1 Nov. 20, 2008

(51) Int. Cl.

| | |
|---|---|
| ***C25C 1/00*** | (2006.01) |
| ***C25C 7/00*** | (2006.01) |
| ***C25B 9/00*** | (2006.01) |

(52) U.S. Cl. ..... 204/252; 204/283; 204/284; 204/288; 204/415; 204/420; 204/517; 204/520; 204/522; 204/539; 204/630; 204/674

(58) Field of Classification Search ..... 204/283, 204/284, 288, 420, 522, 539, 520, 415, 517, 204/630, 674; 205/517, 520, 792.5, 525, 205/624, 377, 521

See application file for complete search history.

(56) References Cited

U.S. PATENT DOCUMENTS

| | | | | |
|---|---|---|---|---|
| 3,265,536 | A * | 8/1966 | Miller et al. | 429/442 |
| 3,692,647 | A | 9/1972 | Chambers et al. | |
| 4,062,744 | A * | 12/1977 | Henrie et al. | 205/577 |
| 5,591,547 | A * | 1/1997 | Yoneda et al. | 429/220 |
| 6,241,872 | B1 * | 6/2001 | Marks et al. | 205/702 |
| 6,537,468 | B1 * | 3/2003 | Hata et al. | 252/511 |
| 2007/0293040 | A1 * | 12/2007 | Emesh et al. | 438/627 |

* cited by examiner

*Primary Examiner* — Harry D Wilkins, III
*Assistant Examiner* — Zulmariam Mendez
(74) *Attorney, Agent, or Firm* — Mark E. Fejer

(57) ABSTRACT

An electrochemical cell for producing copper having a dense graphite anode electrode and a dense graphite cathode electrode disposed in a CuCl solution. An anion exchange membrane made of poly(ethylene vinyl alcohol) and polyethylenimine cross-linked with a cross-linking agent selected from the group consisting of acetone, formaldehyde, glyoxal, glutaraldehyde, and mixtures thereof is disposed between the two electrodes.

16 Claims, 7 Drawing Sheets

CUC1 THERMOCHEMICAL CYCLE FOR HYDROGEN PRODUCTION

The U.S. Government has a paid-up license in this invention and the right in limited circumstances to require the patent owner to license others on reasonable terms as provided for by the terms of Contract No. W-31-109-ENG-38, Subcontract No. ANL-6F-00571 awarded by the U.S. Department of Energy.

BACKGROUND OF THE INVENTION

This invention relates to a method and apparatus for electrochemically producing high porosity, high activity copper powders for high-temperature thermochemical water splitting.

Copper is substantially non-reactive with HCl at room temperature for producing hydrogen. However, at elevated temperatures, e.g. 425° C., copper reacts with HCl to form hydrogen and copper (1) chloride (CuCl). To produce copper and HCl, the copper (1) chloride needs to be cycled. Thus, the net reaction of the entire process is $$2H_2O \rightarrow 2H_2 + O_2$$

The key component of the Cu—Cl cycles is the electrochemical cycle, which has numerous potential barriers that must be overcome. First, there is the issue of materials. The product of CuCl after the electrochemical cycle is copper (2) chloride ($CuCl_2$), which is a strong oxidant and which is highly corrosive. Metallic materials, such as stainless steels, are not suitable for use as a reservoir, electrode plate, or cycle tube line. Second, there is the issue of recycle and separation requirements. The efficiency of the recycle is related to the ion transport rate of the separation membrane, an anion exchange membrane, in the electrochemical cell. Enhancement of the cell efficiency requires that the ionic conductivity be high. In addition, the membrane must be strong and have substantial longevity. Also, because the solubility of CuCl in water is very low, on the order of 0.0062 g/100 ml water, the amount of CuCl in the solution must be increased. Third, there is the issue of electrochemical design. In particular, the electrochemical cell must have high weight/volume power density and high efficiency; and the cell must distribute electricity uniformly in the reaction region. Finally, there is the issue of a skin effect. That is, $CuCl_2$ reacts with water at 325° C., producing as a product $Cu_2OCl_2$, which, due to the coverage of the electrodes by $Cu_2OCl_2$, retards the reaction between water vapor and $CuCl_2$.

SUMMARY OF THE INVENTION

It is, thus, one object of this invention to provide an electrochemical cell which addresses the aforementioned barriers.

This and other objects of this invention are addressed by an electrochemical cell comprising a dense graphite-containing anode electrode and a dense graphite-containing cathode electrode disposed in a CuCl solution, and an anion exchange membrane disposed between the electrodes, which membrane comprises poly(ethylene vinyl alcohol) and polyethylenimine cross-linked with a cross-linking agent selected from the group consisting of acetone, formaldehyde, glyoxal, glutaraldehyde, and mixtures thereof. As used herein, the term "dense" as used to describe the electrodes of the electrochemical cell of this invention refers to electrodes which are gas and liquid impervious. The graphite electrodes have low corrosion rates and are relatively inexpensive to produce. The electrodes are processed to eliminate the growth of copper dendrites on the anion exchange membrane, thereby reducing the risk of shorting the cell. In accordance with one embodiment, the electrodes are coated with an electroconductive polymer to release copper powders formed thereon. Solubility of CuCl in the CuCl solution is increased by the addition of an additive, which results in an increase in current density and, thus, an increase in the reaction rates. In addition, carbon-based materials are added as crystal seeds in the CuCl solution to reduce the copper deposition overpotential, increase copper activity, and reduce the skin effect of $CuOCl_2$.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

The chain of reactions for hydrogen production using high temperature thermo-chemical water splitting is as follows:

| No. | Reaction Step | Temperature |
|---|---|---|
| 1. | $2Cu + 2HCl(g) \rightarrow H_2(g) + 2CuCl$ | 425° C. |
| 2. | $4CuCl \rightarrow 2Cu + 2CuCl_2$ (electrochemical) | Room |
| 3. | $2CuCl_2 + H_2O(g) \rightarrow Cu_2OCl_2 + HCl(g)$ | 325° C. |
| 4. | $Cu_2OCl_2 \rightarrow 2CuCl + \frac{1}{2}O_2(g)$ | 550° C. |

The electrochemical process of reaction No. 2 is believed to be:

| | |
|---|---|
| Anode: | $CuCl(s) + Cl^-(1) \rightarrow CuCl_2(s \text{ or } aq) + e^-$ |
| Cathode: | $CuCl(s) + e^- \rightarrow Cl^-(1) + Cu(s)$ |

Figure 1:
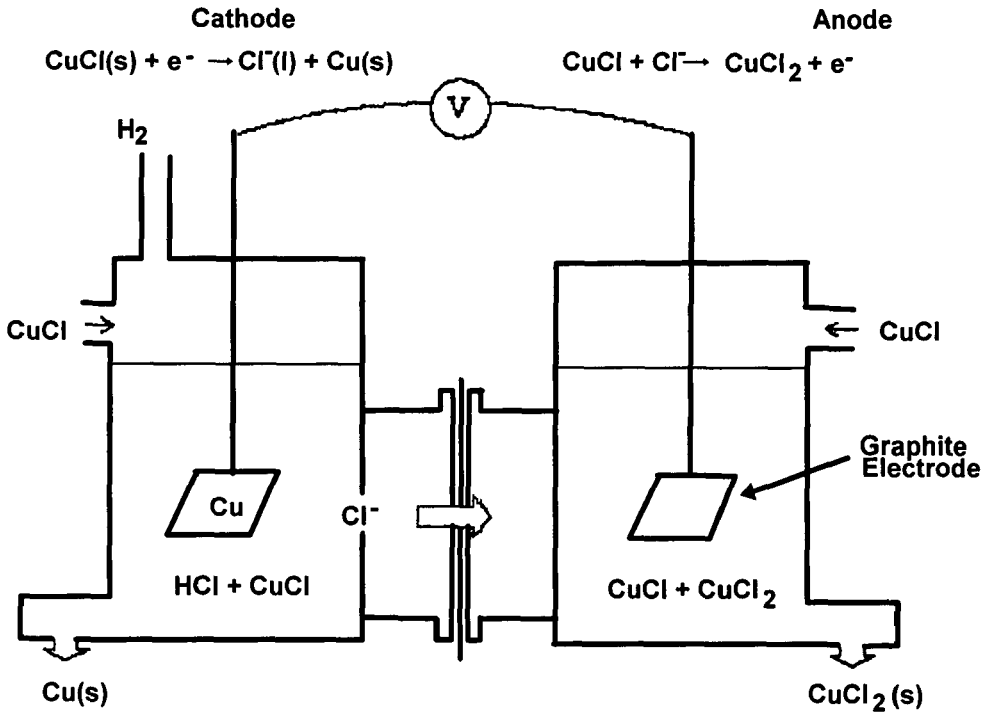
FIG. 1 is a schematic diagram of the electrochemical cycle of Cu.

The electrochemical reactions show that the only ion to transfer from the cathode to the anode is a chloride ion (See FIG. 1). Because Cu is not as active as hydrogen, Cu is more easily deposited than hydrogen is evolved. Thus, it is not a hydrogen evolution process as long as CuCl is present.

Figure 2:
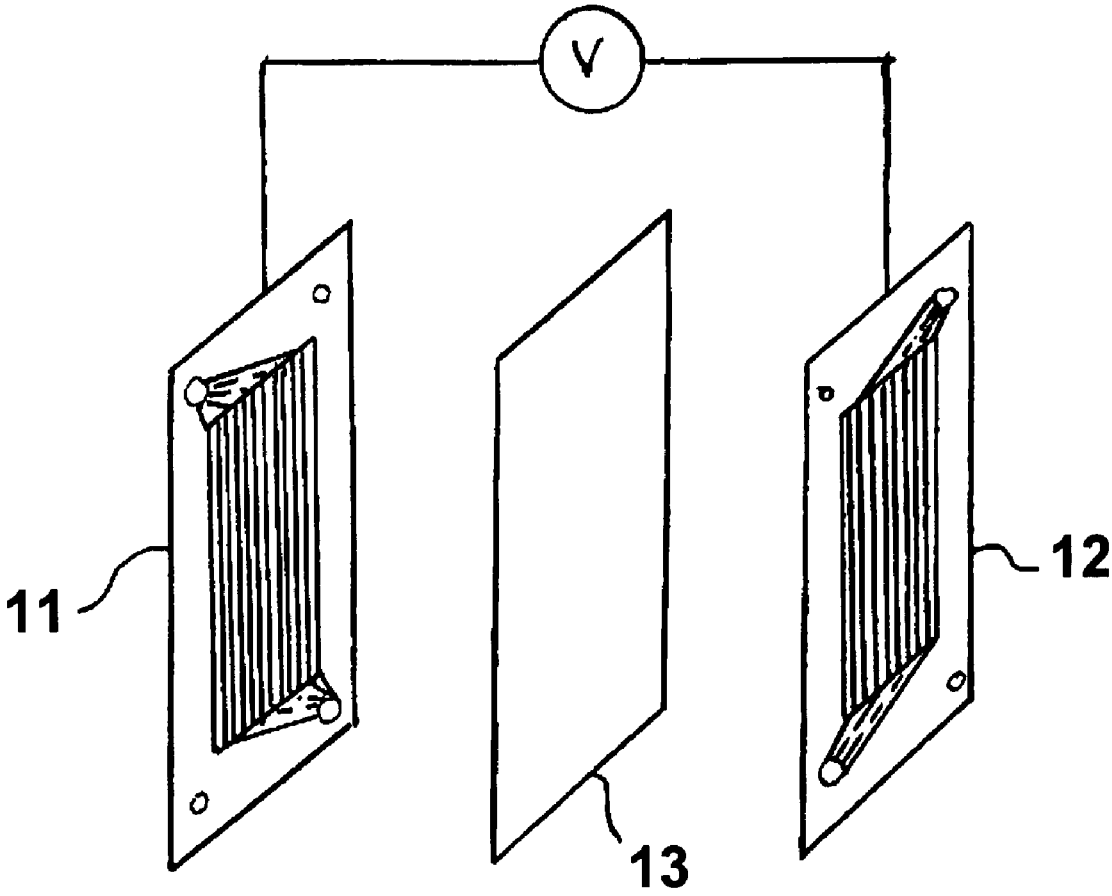
FIG. 2 is an exploded view of an electrochemical cell in accordance with one embodiment of this invention.

An electrochemical cell in accordance with one embodiment of this invention as shown in FIG. 2, comprises a substantially planar anode electrode 11, a substantially planar cathode electrode 12, and an anion exchange membrane 13 disposed between the electrodes. The electrodes are gas and liquid impervious and comprise at least one electronically conductive material in an amount in a range of about 50% to 95% by weight of the electrodes and at least one resin in an amount of at least 5% by weight of the electrodes. In accordance with one embodiment of this invention, the electronically conductive material and the resin are uniformly distributed throughout the electrodes. In accordance with one preferred embodiment of this invention, the electronically conductive material is an electronically conductive carbonaceous material. In accordance with one particularly preferred embodiment of this invention, the carbonaceous material is selected from the group consisting of graphite, carbon particles, carbon fibers, and mixtures thereof. The composition is molded at an elevated temperature in a range of about 250° F. to about 800° F. and a pressure in a range of about 500 psi to about 4,000 psi.

Figure 6:
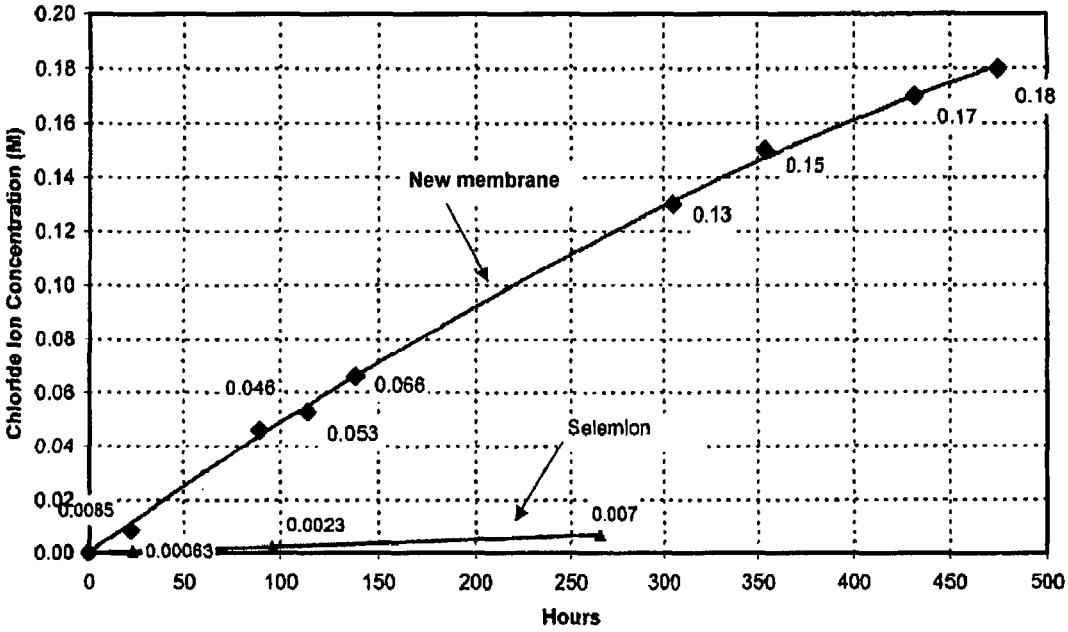
FIG. 6 is a diagram showing membrane chloride ion transfer with no applied voltage.

Anion exchange membranes that transfer anions are commercially available. For example, SELEMION® AST (Asahi Glass, Tokyo, Japan), which is widely used in the desalination applications, is a monovalent anion exchange membrane. Selemion is a suitable membrane for chloride ion transport; however, the transport rate is relatively low as shown in FIG. 6.

Figure 3:
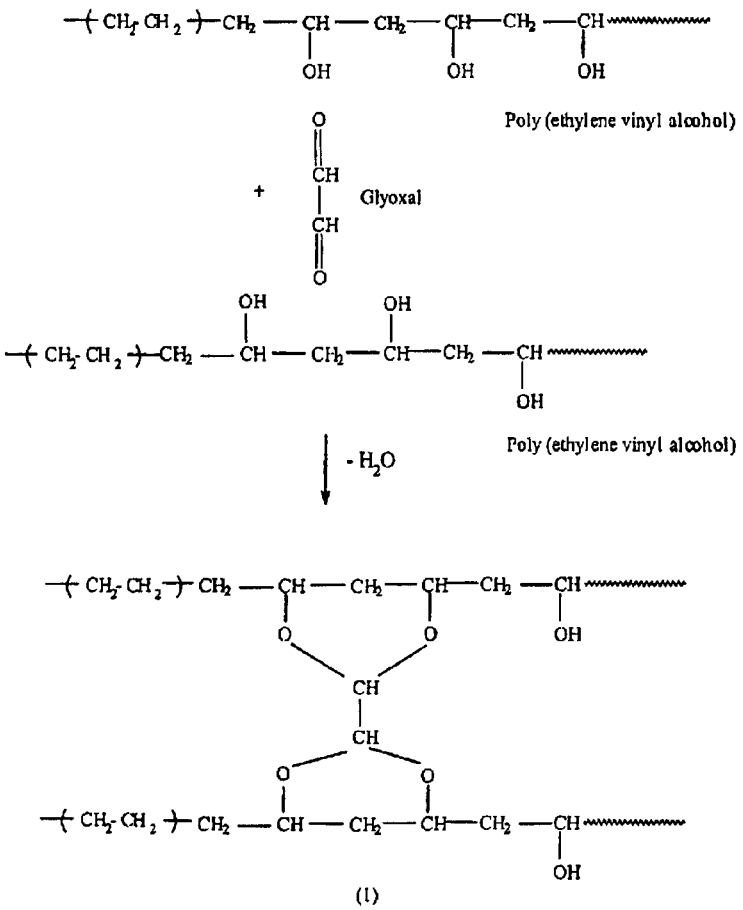
FIG. 3 is a diagram showing the synthesis of an anion exchange membrane suitable for use in accordance with one embodiment of this invention.
Figure 3:
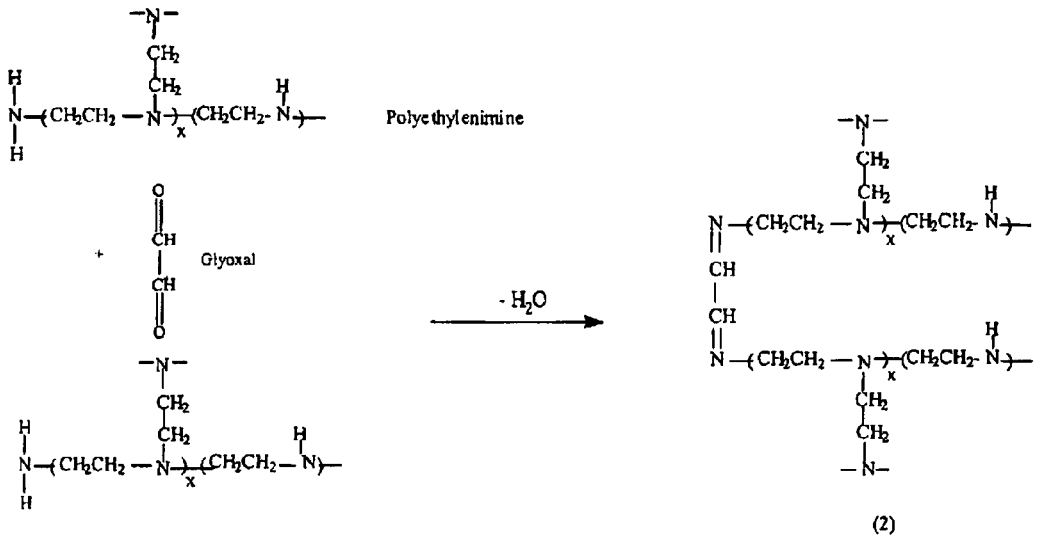

The anion exchange membrane of the electrochemical cell in accordance with one embodiment of this invention comprises a cross-linked anion exchange group. Synthesis of the anion exchange membrane is shown in FIG. 3. As shown therein, the membrane is a composite of poly(ethylene vinyl alcohol) and polyethylenimine cross-linked with a cross-linking agent. Suitable cross-linking agents are selected from the group consisting of acetone, formaldehyde, glyoxal, glutaraldehyde, and mixtures thereof. The glutaraldehyde cross-linked membrane is particularly strong and stable. The ethylene backbone in the cross-linked membrane makes the membrane flexible and strong. The anion exchange sites in the composite membrane are the NH and $NH_2$ groups. The membrane shows very good stability in water and has good permeability for chloride ions.

As previously indicated, copper (1) chloride, having a solubility of only about 0.0062 grams per 100 ml of water, is not very soluble in water. Such a small concentration of the reactant limits the reaction rate by not providing sufficient reactant onto the electrode surface. However, if the concentration of HCl in the water is increased, the CuCl solubility increases due to the formation of $CuCl_2^-$, indicating that copper forms at a rate of five times faster. For example, 2M HCl in the solution results in a CuCl concentration of about 0.2M. Other additives suitable for increasing the solubility of CuCl include chloride salts, ammonium salts, and mixtures thereof. Electrochemical deposition of copper at a small current forms a densely packed smooth layer of copper, while electrochemical deposition of copper at large currents forms a porous layer of copper which is easily removed from the cell.

Once the copper forms in the electrolyzer, the means by which it is removed from the electrolyzer becomes a significant issue. On the cathode side of the electrolyzer, copper usually forms at the electrode surface having the highest current density area.

Figure 4:
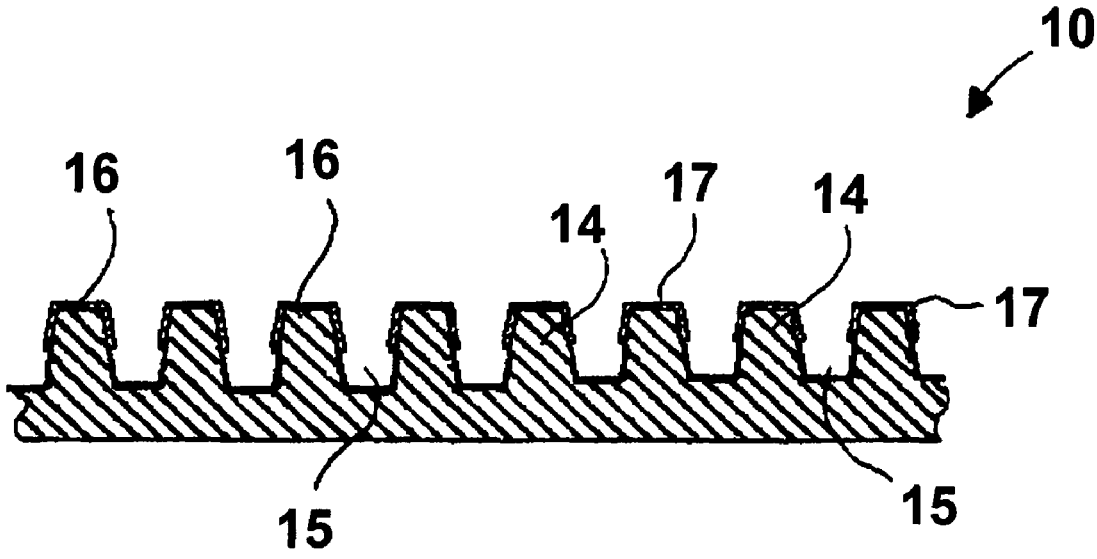
FIG. 4 is a cross-sectional view of a graphite electrode employed in the electrochemical cell in accordance with one embodiment of this invention.
Figure 5:
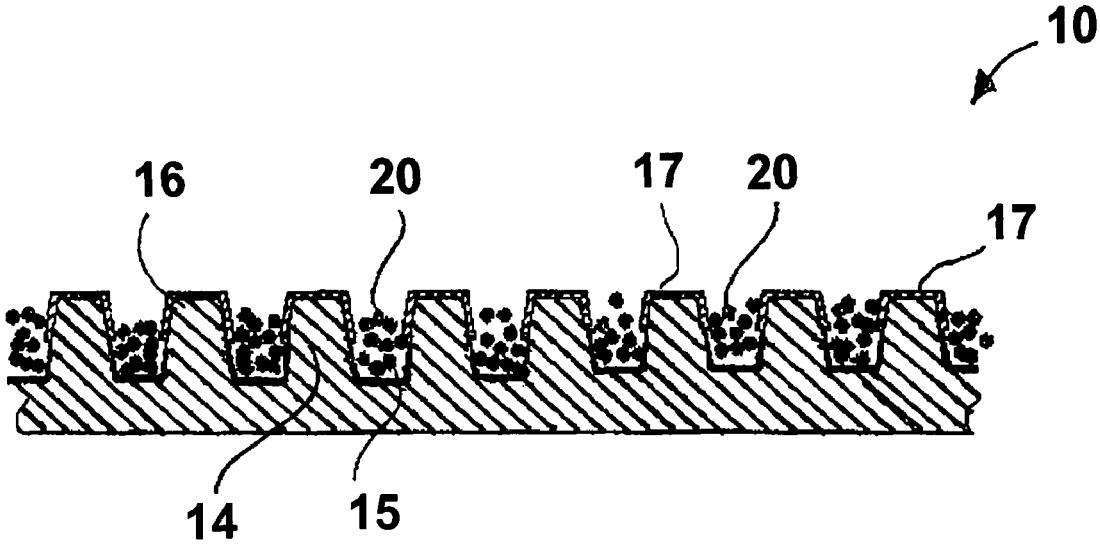
FIG. 5 is a cross-sectional view of a graphite electrode employed in the electrochemical cell in accordance with one embodiment of this invention with Cu deposition.

FIG. 4 shows a cross-section of a planar electrode suitable for use in accordance with one embodiment of the apparatus of this invention. As shown therein, at least one surface of the electrode forms a plurality of ribs 14 with flow channels 15 disposed between the ribs. With the electrode design shown in FIG. 3, the highest current density region is at the peaks 16 of the ribs 14. Because water flows in the flow channels 15 of the electrolyzer flow field farther away from the anode than the peak of the ribs, the copper formed on the peaks of the ribs is not easily carried out by the water flow. As a result, the accumulation of the copper formed on top of the ribs could eventually block the anion exchange membrane, and even pierce through the membrane, leading to a mix of copper (0) on the cathode side of the membrane and copper (II) on the anode side resulting in shorting of the cell. Copper (0) and copper (II) can react to form Cu (I). However, this reverse reaction reduces the efficiency of the entire electrolyzer reactor. To prevent this adverse phenomenon from occurring, in accordance with one embodiment of this invention, the peaks of the ribs are covered with an electric insulating layer 17, leaving only the flow channels conductive. This allows copper 20 to be formed in the flow channels of the flow field which is easily removed by the water flowing through the flow channels. In accordance with one embodiment of this invention, a layer of polyaniline is applied to the flow channels to prevent the formation of a copper metal layer. Use of the polyaniline layer results in the formation of micro copper powders in the flow channels (FIG. 5).

Example

In this example, an anion exchange membrane is prepared by blending two polymers in different ratios and then casting the membrane on a glass plate laminated with a TEFLON® substrate. The materials employed for this purpose, all of which are available from Aldrich Chemicals, include poly (ethylene vinyl alcohol), 32% ethylene, polyethylenimine, molecular weight 25000, 38% by weight glyoxal solution, methylsulfoxide, and CAB-O-SIL® silica. The details comprise making 10-weight percent solution of poly(ethylene vinyl alcohol) in methylsulfoxide (Solution A—10.0 g poly (ethylene vinyl alcohol) and 90.0 g methylsulfoxide) and 10 weight percent polyethylenimine in methylsulfoxide (Solution B—10.0 g polyethylenimine and 90.0 g methylsulfoxide). Although not required, warming the solutions to about 50° C. promotes rapid polymer dissolution. Thereafter, 80.0 grams of Solution A are mixed in a beaker with 20.0 grams of solution, stirring for about an hour so that they mix thoroughly. After thorough mixing, 0.2 g silica (2% on polymer) are added to the mixture and mixed for an additional two hours. Next, 3.2 g glyoxal solution is added drop by drop into the blend of solutions A and B and stirred for about an hour. If glyoxal is added all at once to the solution blend, white precipitate occurs, which requires a long time to re-dissolve. Accordingly, it is advisable that the glyoxal be added very slowly. The resulting solution is filtered and allowed to stand unstirred to allow bubbles present therein to subside. The resulting mixture is cast onto a glass plate laminated with TEFLON substrate and allowed to dry overnight. Next, the glass plate is slowly dipped in a shallow container of deionized water for 15 minutes, resulting in the leaching out of most of the remaining solvent into the water. The glass plate, which now comprises an anion exchange membrane, is removed from the water, wiped with a tissue, and placed in an oven at about 80° C. for an hour to dry and cure. The membrane is then detached from the TEFLON substrate.

Membranes were prepared with different ratios of PEVOH and PEI (90/10; 85/15; and 80/20) to optimize the ratio of poly(ethylene vinyl alcohol) to polyethylenimine. Tests result have determined that, although not required, the preferred ratio is 80/20.

As indicated in the above example, glyoxal was used as a cross-linking agent. The flexibility of the membrane and the porosity of the membrane both depend upon the amount of cross-linking agent used and the degree of cross-link. Too much cross-link makes the membrane brittle. Only that amount of glyoxal which renders the membrane flexible and water insoluble is required. In addition to glyoxal, other cross-linking agents which may be employed are formaldehyde, glutaraldehyde, acetone and mixtures thereof.

FIG. 6 is a diagram showing membrane chloride ion transfer through the cast membrane with no applied voltage. As shown therein, the transport rate for the membrane produced in accordance with the above procedure is substantially higher than the rate for the commercially available SELEMION.

Figure 7:
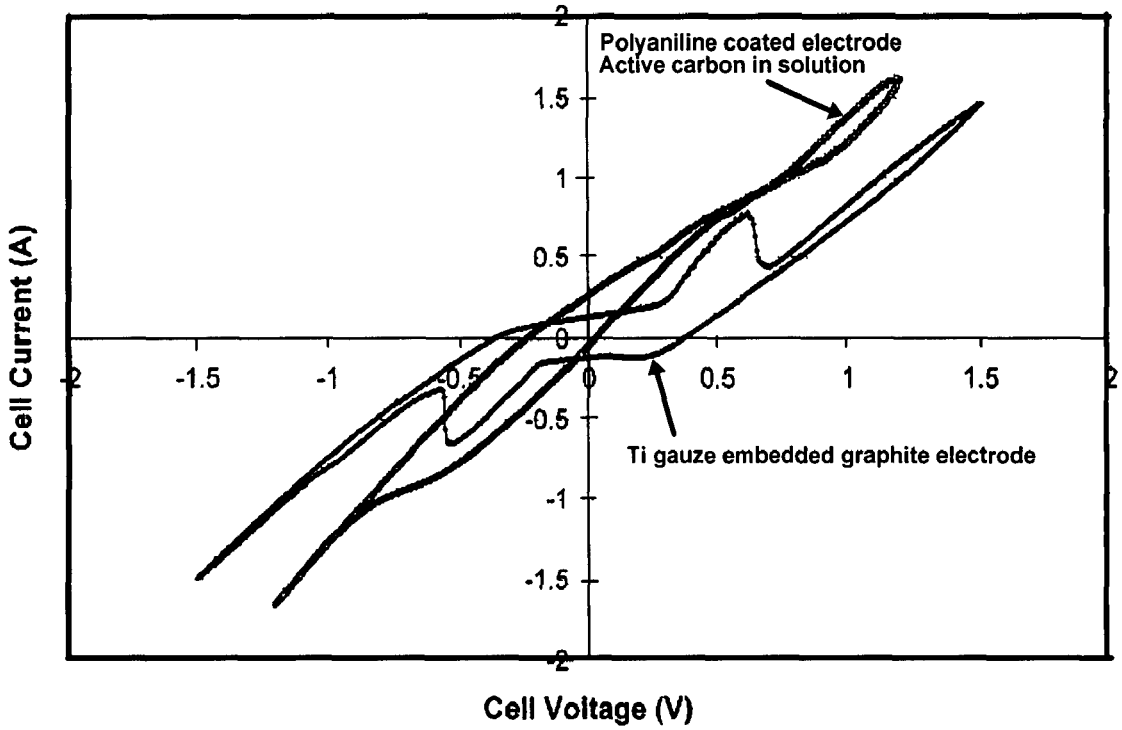
FIG. 7 is a diagram showing a cyclic voltammogram comparison of a Ti gauze embedded graphite cathode with a polyaniline coated graphite cathode.

FIG. 7 is a diagram showing a cyclic voltammogram comparison of a Ti gauze embedded graphite cathode with a polyaniline coated graphite cathode with active carbon crystal seeds (VULCAN® XC-72 carbon black) in accordance with one embodiment of this invention in a CuCl solution. In addition to carbon black, graphite powders may also be employed as active carbon crystal seeds. The active carbon crystal seeds preferably have a particle size of less than or equal to about 6 microns. In accordance with one embodiment of this invention, the amount of active carbon crystal seeds is in the range of about 0.0167 to about 0.167 moles per liter of solution. As shown in FIG. 7, the Cu deposition and oxidation peaks present with the Ti gauze embedded graphite cathode are not evident when using the polyaniline coating and active carbon crystal seeds in solution. Thus, it is apparent that the polymer coating and the active carbon crystal seeds facilitate the Cu powder release from the electrode.

Alternatively, if no carbon black or other active carbon crystal seeds are added to the solution a pulse of reversed electrode potential may be used to facilitate release of the copper from the electrode plates. By way of example, we have found that in each potential period cycle of an electrochemical cell in accordance with one embodiment of this invention, for every 40 seconds to 5 minutes of −0.6V to deposit copper on the electrode, 10 seconds of +0.67V resulted in release of the copper.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. An electrochemical cell for producing copper comprising:

a dense substantially planar graphite anode electrode and a dense substantially planar graphite cathode electrode disposed in a CuCl solution;

an anion exchange membrane disposed between said electrodes, said membrane comprising poly(ethylene vinyl alcohol) and polyethylenimine cross-linked with a cross-linking agent selected from the group consisting of acetone, formaldehyde, glyoxal, glutaraldehyde, and mixtures thereof; and said electrodes having a ribbed anion exchange membrane facing surface and a ribbed opposite facing surface facing away from said anion exchange membrane, said ribs on said opposite facing surface facing away from said anion exchange membrane being electrically insulated.

2. An electrochemical cell in accordance with claim 1, wherein said CuCl solution comprises an additive for increasing CuCl solubility in said CuCl solution.

3. An electrochemical cell in accordance with claim 2, wherein said additive is selected from the group consisting of HCl, chloride salts, ammonium salts, and mixtures thereof.

4. An electrochemical cell in accordance with claim 1, wherein said CuCl solution is seeded with a carbon-based material.

5. An electrochemical cell in accordance with claim 4, wherein said carbon-based material is selected from the group consisting of graphite powder, carbon powder, and mixtures thereof.

6. An electrochemical cell in accordance with claim 5, wherein said powders have a particle size less than or equal to about 6 microns.

7. An electrochemical cell in accordance with claim 1, wherein spaces between said electrically insulated ribs are coated with an electrically conductive polymer coating.

8. An electrochemical cell in accordance with claim 1, wherein said ribs on said surface facing away from said anion exchange membrane are formed of a plastic material.

9. An electrochemical cell in accordance with claim 4, wherein said carbon-based material is carbon black in an amount of about 0.0167 to about 0.167 moles per liter of said CuCl solution.

10. An electrochemical cell comprising:

a dense, substantially planar graphite anode electrode and a dense, substantially planar graphite cathode electrode disposed in a CuCl solution;

an anion exchange membrane disposed between said electrodes, said membrane comprising poly(ethylene vinyl alcohol) and polyethylenimine cross-linked with a cross-linking agent selected from the group consisting of acetone, formaldehyde, glyoxal, glutaraldehyde, and mixtures thereof; and said electrodes having a ribbed anion exchange membrane facing surface and a ribbed opposite facing surface, wherein said ribs on said oppositely facing surface are electrically non-conductive and spaces between said electrically insulated ribs are electrically conductive.

11. The electrochemical cell of claim 10, wherein said CuCl solution comprises an additive for increasing CuCl solubility in said CuCl solution.

12. The electrochemical cell of claim 11, wherein said additive is selected from the group consisting of HCl, chloride salts, ammonium salts, and mixtures thereof.

13. The electrochemical cell of claim 12, wherein said CuCl solution is seeded with a carbon-based material selected from the group consisting of graphite powder, carbon powder, and mixtures thereof.

14. The electrochemical cell of claim 13, wherein said carbon-based material is carbon black in an amount of about 0.0167 to about 0.167 moles per liter of said CuCl solution.

15. The electrochemical cell of claim 10, wherein said spaces between said electrically insulated ribs are coated with an electrically conductive polymer coating.

16. The electrochemical cell of claim 15, wherein said electrically insulated ribs are coated with an electrically insulating material.

* * * * *